United States Patent [19]

Lüber

[11] 4,143,679

[45] Mar. 13, 1979

[54] FABRIC HAVING A REINFORCED WARP STRIP AND A PROCESS FOR PRODUCING THE SAME

[75] Inventor: Paul Lüber, Winterthur, Switzerland

[73] Assignee: Sulzer Brothers Ltd., Winterthur, Switzerland

[21] Appl. No.: 870,628

[22] Filed: Jan. 19, 1978

Related U.S. Application Data

[63] Continuation of Ser. No. 709,711, Jul. 29, 1976, abandoned.

[30] Foreign Application Priority Data

Aug. 7, 1975 [CH] Switzerland ..... 010297/75

[51] Int. Cl.[2] ..... D03D 23/00

[52] U.S. Cl. ..... 139/383 R; 139/407

[58] Field of Search ..... 139/383 R, 407, 54, 139/430, 434

[56] References Cited

U.S. PATENT DOCUMENTS

| | | | |
|---|---|---|---|
| 1,948,051 | 2/1934 | Rossmann | 139/434 |
| 2,145,715 | 1/1939 | Dick | 139/383 R |
| 2,185,308 | 1/1940 | Pfarrwaller | 139/434 |
| 2,267,287 | 12/1941 | Moessinger | 139/434 |
| 2,916,798 | 12/1959 | Caputa et al. | 139/383 R |
| 3,144,882 | 8/1964 | Steiner | 139/383 R |
| 3,361,164 | 1/1968 | Kathriner | 139/383 R |
| 3,952,778 | 4/1976 | Volpe | 139/54 |

*Primary Examiner*—James Kee Chi

*Attorney, Agent, or Firm*—Kenyon & Kenyon, Reilly, Carr & Chapin

[57] ABSTRACT

The fabric is woven with a reinforced warp strip between the background section and the selvage to allow spreading out of the fabric without using needle rollers in the background section. The reinforced warp strip may be formed with a permanent strip portion which remains with the background section and a removable reinforced strip portion which can be severed from the fabric.

9 Claims, 4 Drawing Figures

FABRIC HAVING A REINFORCED WARP STRIP AND A PROCESS FOR PRODUCING THE SAME

This is a continuation of application Ser. No. 709,711 filed July 29, 1976, now abandoned.

This invention relates to a fabric having a reinforced warp strip and a process for producing the same.

Heretofore, various techniques have been known for reinforcing the edges of fabrics in order to allow mechanical devices to grip and spread out the fabric. In one instance, it has been known to form a fabric with a background section and a compacted warp strip on each longitudinal edge to permit gripping and spreading. In this case, the compacted warp strips have usually been partially cut-off from the remainder of the fabric for subsequent finishing. This process, however, creates difficulties when weaving fabrics having inturned weft ends. For example, on looms which insert the weft-threaded ends via gripper shuttles or rods, the reinforced warp strips may become too thick or too undulated in the region of the inserted weft-threaded ends while the fabric near the strips remains smooth. Further, with greater weft densities, the weft-thread ends become increasingly more difficult to retain in the fabric.

Accordingly, it is an object of the invention to provide a fabric which is reinforced for spreading purposes and which is able to retain weft-thread ends in a secure manner.

It is another object of the invention to provide a simple process for forming a fabric with reinforced warp strips.

Briefly, the invention provides a fabric having reinforced warp strips and a process of producing the same.

The fabric includes a background section and an adjacent reinforced warp strip on each side. Each reinforced warp strip includes a selvage and an adjoining strip section between the selvage and the background section and is made such that the selvage is weaker in the warp direction than the adjoining strip section.

The term "reinforced warp strip" is used herein with the term "warp strengthened strip" to indicate that the tensile strength of a strip in the warp direction is increased relative to the tensile strength of the background section by increasing the warp density of the strip, i.e., increasing the number of warp threads per unit of width, e.g., per centimeter (cm), or by using heavier thread in the strip than in the background, or by using thread of different and stronger material in the strip than in the background. In some instances, a number of these features can be combined. Similarly, the term "weakened warp strip" is used to indicate the opposite.

The process of the invention includes the weaving of warp threads and weft threads into a fabric formed of a background section of warp threads of predetermined warp density and forming a reinforced warp strip adjacent each side of the background section; the reinforced warp strip being composed of a selvage and at least one reinforced strip portion. The reinforced strip portion is further made with a greater warp density than the selvage and the background section so that the selvage is weaker than the reinforced strip portion. In addition, the process includes the steps of forming a second reinforced strip portion in the warp strip spaced from the first reinforced strip portion to define a gap which extends longitudinally of the fabric. This gap allows the second reinforced strip portion and selvage to be cut-away while leaving a reinforced strip portion on the background section.

The warp weakening of the selvage relative to the remainder of the reinforced warp strip allows the weft thread ends to be inserted and enclosed without difficulty, particularly in the case of a relatively compact weft and closely beaten-up fabric.

These and other objects and advantages of the invention will become more apparent from the following detailed description and appended claims taken in conjunction with the accompanying drawings in which:

Figure 1:
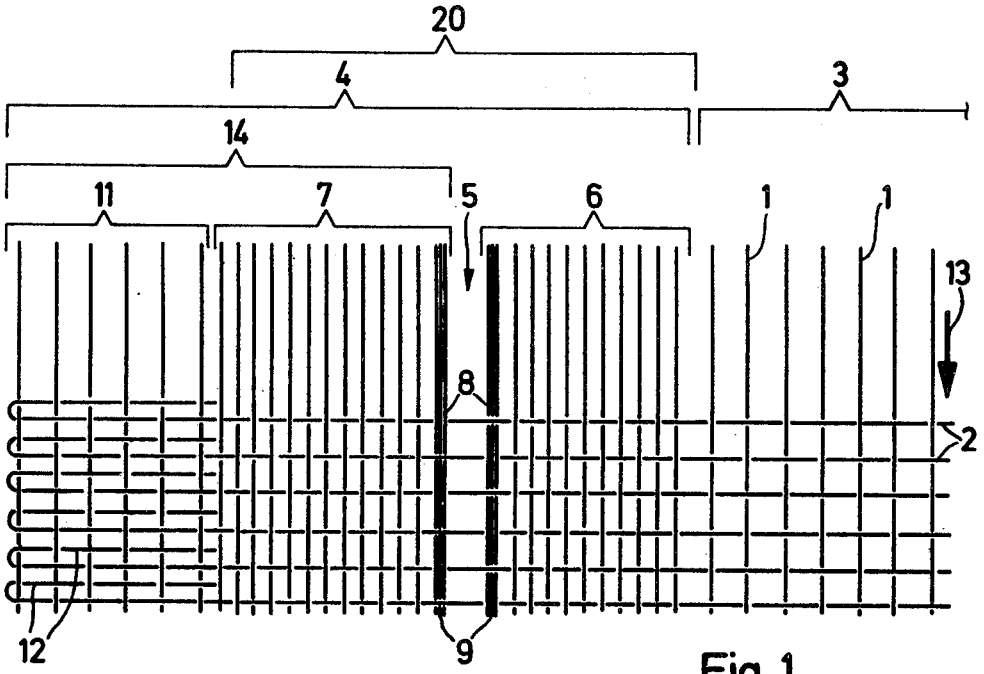
FIG. 1 illustrates a plan view of a fabric made in accordance with the invention.

Referring to FIG. 1, the fabric which is symmetrical along a mid-line is woven of warp threads 1 and weft threads 2. These threads 1, 2 are usually woven in closely spaced relation but are shown with exaggerated spacings for clarity. The fabric includes a background section 3 and an adjacent reinforced warp strip 4 at each side. Each warp strip 4 includes a permanent reinforced strip portion 6 and removable reinforced strip section 7 which are separated by a gap 5 as well as a selvage 11. The gap 5 is defined on both sides by two twisted threads 8, 9.

As indicated, the two strip portions 6, 7 have double the warp density of the background section 3 while the selvage 11 has the same warp density and disposition as the background section 3. In addition, the ends 12 of the weft threads 2 are inserted only in the selvage 11 as shown.

During production, the produced fabric moves in the direction indicated by the arrow 13 with the usual shedding operations taking place. Further, the weft threads 2 are picked into the shed by suitable means such as gripper shuttles (not shown). After a change of shed, the weft thread ends 12 are each successively placed into the next shed by a suitable tucking needle as is known. After beat-up, the fabric moves over a temple (not shown) at each side. Assuming that a velvet or plush fabric is being woven, and because such a fabric would be impaired by the pricking of needles into the background section 3 from the needle-rollers of a spreader arrangement, the temple 21 has needle rollers 22 only in the region A of the reinforced warp strip 4. In the region B of the background section 3, use is made of needle-less (i.e., blank) rollers 23 in the form of support rollers. Because of the reinforced warp strip 4, a relatively small number of needle-rollers 22 can be used to exert a width-holding force (i.e., a spreading force) in the region A in the direction of the weft threads 2 sufficient for weaving widths, for example up to three to five meters and more.

After passing through the temple 21, the cut-off strip 14 comprised of the selvage 11 and removable strip portion 7 is removed by severing the fabric within the gap 5 by a suitable cutter, for example a knife or shears, (not shown) on the loom. Thus, only the permanent reinforced strip portion 6 remains with the background section 3. The permanent strip portions 6 allow the fabric to undergo the usual finishing operations by providing edges which can be gripped by various gripping tools of the finishing equipment.

Referring to FIG. 1, the warp density in the strip portions 6, 7 is twice that of the background section 3 and the selvage 11. The selvage 11 has the same warp density as the background section 3 as well as a greater weft density due to the inserted weft thread ends 12. Since the density of the selvage is not too great, the weft thread ends 12 can be enclosed in the fabric without difficulty and beaten-up. Numerically, the warp density of the fabric may be approximately as follows:

| Fabric Region | No. of reeds | Warp threads per reed | Warp density per cm |
|---|---|---|---|
| Background 3 | 1470 | 2 | 22.4 |
| Permanent portion 6 | 12 | 4 | 44.8 |
| Removable portion 7 | 13 | 4 | 44.8 |
| Selvage 11 | 12 | 2 | 22.4 |
| Gap 5 | 5 | 0 | — |

In this example, 11.2 reeds per centimeter are used. The warp threads 1 and the weft threads 2 may for example be of Ne 30/1 cotton in the background section 3, the permanent portion 6 and the removable strip portion 7; while the warp threads in the selvage 11 consist of Ne 20/1 cotton.

Figure 2:
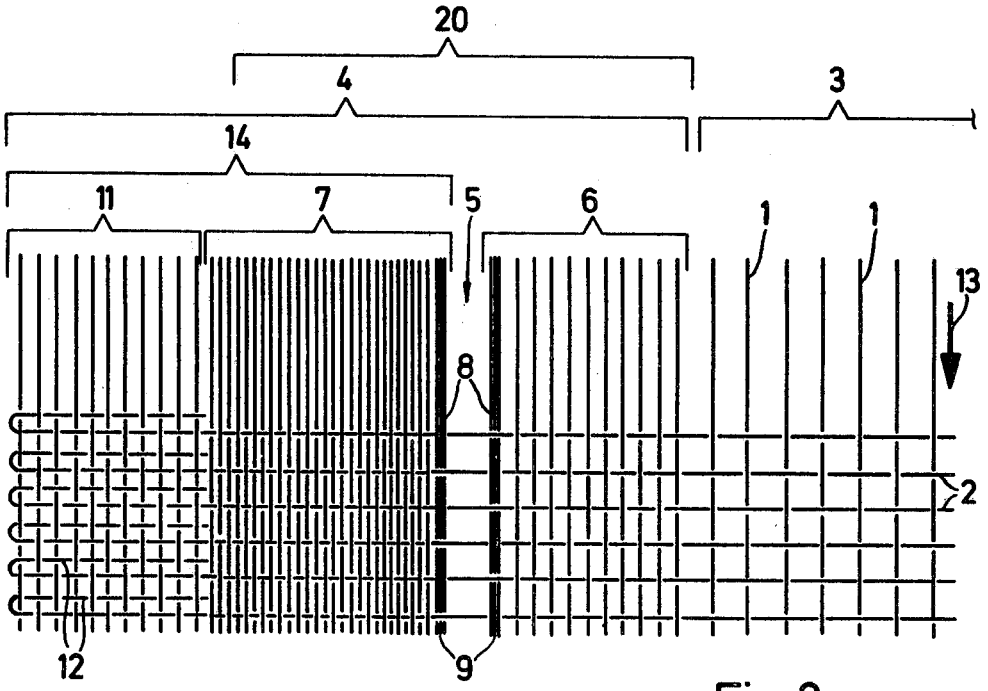
FIG. 2 illustrates a plan view of a modified fabric according to the invention.

Referring to FIG. 2, wherein like reference characters indicate like parts as above, the fabric may also be made with a removable reinforced strip portion 7 which has a warp density four times that of the background section 3 and a selvage 11 which has a warp density twice that of the background section 3. In this case, the warp density in the selvage 11 and the permanent reinforced strip portion 6 is the same. This distribution of warp densities in the cut-off strip 14 is possible if use is made of light-weight weft material so that the weft thread ends 12 can be inserted without difficulties.

Figure 3:
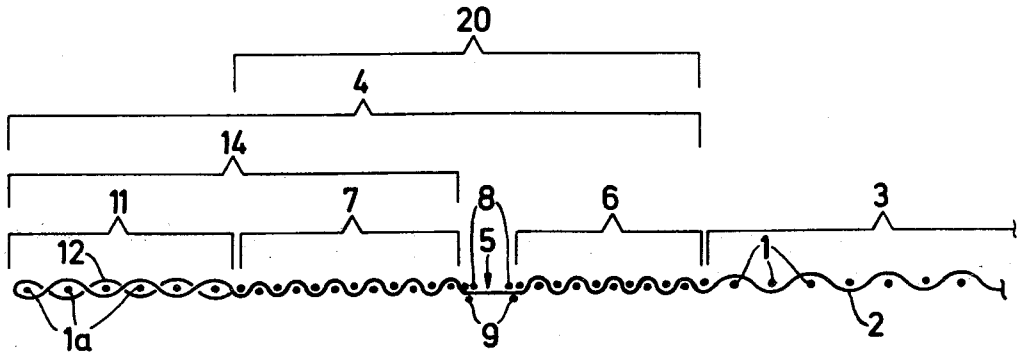
FIG. 3 illustrates a cross-sectional view through the warp of a further modified fabric according to the invention.
Figure 4:
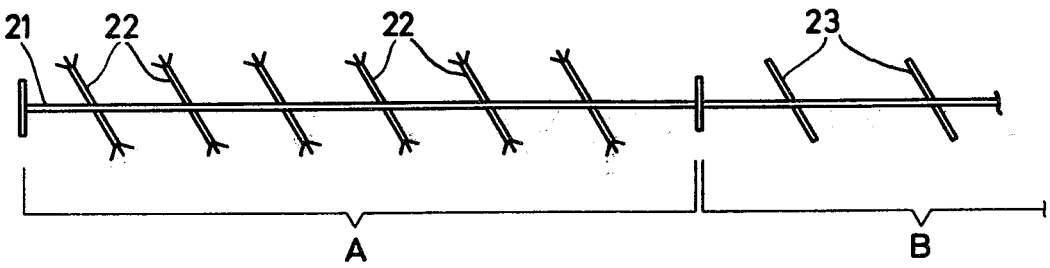
FIG. 4 schematically illustrates an arrangement of spreader rolls in a weaving machine on which a fabric is woven in accordance with the invention.

Referring to FIG. 3, wherein like reference characters indicate like parts as above, the fabric may also be made with strip portions 6, 7 of the same warp density (as in FIG. 1) and with the selvage 11 and background section 3 of the same warp density (as in FIG. 1). However, the warp threads 1*a* in the selvage 11 are made of a heavier or coarser material, such as Ne 16/1, to have a greater tensile strength and, thus, greater warp strength than the warp threads 1 in the background section 3. Thus, the selvage 11 is stronger than the background section 3 but remains weaker than the reinforced strip portion 7.

The tensile strength or warp strength in the individual sections of the strip 4, based on the actual degree of strengthening, may for example be tested or measured with apparatus for measuring the rupture-strength of fabrics.

Modified forms of the fabric are obtained when, for example the warp threads in the selvage 11 of FIG. 1 consist of a material of higher tensile strength than the warp threads 1 in the background 3 and, on occasiion, in the permanent strip portion 6 as well as in the removable strip portion 7. If desired, the warp threads used in the selvage 11 may be heavier or even lighter than the warp threads 1 of the background 3 and of the portions 7, 6, so long as the selvage 11 remains weaker in the warp direction than the removable strip portion 7.

The gap or cutting lane 5 may also be eliminated so that the permanent strip portion 6 directly adjoins the removable strip portion 7. If the width of the reinforced warp strip 4 is not a hindrance, it is also possible to dispense with the cutting. If desired, an outer strip part, corresponding to the cut strip 14, may be severed without using a gap 5. This is, for example possible with synthetic threads, the strip portions 6, 7 being severed between them by means of an electrically-heated wire, whereby the threads at the place of severance become bonded together.

The invention thus provides a process which is suitable particularly for delicate fabrics, such as velvet, which should not show pricks from needle-rollers of a temple in their background. The invention further allows weaving to be done with spreaders having fewer needle-rollers, which rollers engage only the reinforced strips. Because of the strip-reinforcement, it is possible for the needle-rollers to impart an adequate spreading force for great widths of weaving and closely beaten-up fabrics.

What is claimed is:

1. A woven fabric having warp threads and weft theads forming a background section and an adjacent reinforced warp strip, said reinforced warp strip having a selvage and an adjoining strip section between said selvage and said background section wherein said selvage is weaker in the warp direction than said strip section and said weft threads have looped ends of a length equal to the width of said selvage.

2. A woven fabric as set forth in claim 1 wherein said selvage has a thread density less than said strip section.

3. A woven fabric as set forth in claim 1 wherein said selvage and said background section each have warp threads of the same material, said warp threads of said selvage being of greater thickness than said warp threads of said background section, and said selvage having a warp thread density less than said strip section.

4. A woven fabric as set forth in claim 1 wherein said selvage has warp threads of greater tensile strength than the warp threads of said background section and of less tensile strength than the warp threads of said strip section.

5. A woven fabric as set forth in claim 1 wherein said selvage is reinforced in the warp direction relative to said background section.

6. A woven fabric as set forth in claim 1 wherein said selvage and said strip section are of equal warp thickness.

7. A woven fabric as set forth in claim 1 wherein said strip section has a removable reinforced strip portion adjacent said selvage and a permanent reinforced strip portion adjacent said background section and separated from said removable reinforced strip portion to define a gap therewith, said removable reinforced strip portion having a greater warp thread density than said permanent strip portion.

8. A process for the production of a fabric comprising the steps of forming a background section of warp threads of predetermined warp density and interwoven weft threads; and forming a reinforced warp strip adjacent each side of the background section composed of a selvage having the ends of the weft threads inserted therein and at least one reinforced strip portion between the selvage and the background section without said weft ends therein, said reinforced strip portion having a greater warp density than the selvage and the background section whereby the selvage is weaker than the reinforced strip portion.

9. A process as set forth in claim 8 which further comprises the step of forming a second reinforced strip portion in the warp strip spaced from the first reinforced strip portion to define a gap extending longitudinally of the fabric.

* * * * *

UNITED STATES PATENT AND TRADEMARK OFFICE

CERTIFICATE OF CORRECTION

PATENT NO. : 4,143,679

DATED : March 13, 1979

INVENTOR(S) : Paul Luber

It is certified that error appears in the above-identified patent and that said Letters Patent are hereby corrected as shown below:

Column 1, lines 19 - 20, change "weft-threaded" to --weft-thread--

Column 1, line 22, change "weft-threaded" to --weft-thread--

Column 1, line 65, change "the steps" to --the step--

Column 4, lines 16-17, change "weft theads" to --weft-threads--

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*